US011174566B2

(12) United States Patent
Wachter et al.

(10) Patent No.: US 11,174,566 B2
(45) Date of Patent: Nov. 16, 2021

(54) AQUEOUS ACIDIC COPPER ELECTROPLATING BATH AND METHOD FOR ELECTROLYTICALLY DEPOSITING OF A COPPER COATING

(71) Applicant: Atotech Deutschland GmbH, Berlin (DE)

(72) Inventors: Philipp Wachter, Berlin (DE); Stefan Kretschmer, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 0 days.

(21) Appl. No.: 16/620,535

(22) PCT Filed: May 31, 2018

(86) PCT No.: PCT/EP2018/064337
§ 371 (c)(1),
(2) Date: Dec. 9, 2019

(87) PCT Pub. No.: WO2018/228821
PCT Pub. Date: Dec. 20, 2018

(65) Prior Publication Data

US 2020/0141018 A1 May 7, 2020

(30) Foreign Application Priority Data

Jun. 16, 2017 (EP) ..... 17176308

(51) Int. Cl.
*C25D 3/38* (2006.01)
*C25D 5/00* (2006.01)

(52) U.S. Cl.
CPC ..... *C25D 3/38* (2013.01)

(58) Field of Classification Search
CPC ..... C25D 3/38; C25D 5/00
USPC ..... 205/296, 297, 298
See application file for complete search history.

(56) References Cited

U.S. PATENT DOCUMENTS

| | | | | |
|---|---|---|---|---|
| 2,707,166 | A | 4/1955 | Brown | |
| 2,842,488 | A * | 7/1958 | Kirstahler | A21D 2/32 205/297 |
| 3,267,010 | A * | 8/1966 | Creutz | C25D 3/38 205/298 |
| 3,770,598 | A * | 11/1973 | Creutz | C25D 3/38 205/296 |
| 4,110,176 | A | 8/1978 | Creutz et al. | |
| 4,336,114 | A | 6/1982 | Mayer et al. | |
| 4,376,685 | A | 3/1983 | Watson | |
| 6,682,642 | B2 | 1/2004 | Mikkola et al. | |
| 2008/0210569 | A1 | 9/2008 | Dahms et al. | |
| 2014/0238868 | A1* | 8/2014 | Li | C25D 7/12 205/296 |

FOREIGN PATENT DOCUMENTS

DE 19643091 4/1998

OTHER PUBLICATIONS

PCT/EP2018/064337; PCT International Search Report and Written Opinion of the International Searching Authority dated Jul. 2, 2018.

* cited by examiner

*Primary Examiner* — Edna Wong
(74) *Attorney, Agent, or Firm* — Renner, Otto, Boisselle & Sklar, LLP

(57) ABSTRACT

Aqueous acidic copper electroplating bath comprising: copper ions; at least one acid; halide ions; at least one sulfur containing compound selected form the group consisting of sodium 3-mercaptopropylsulfonate, bis(sodiumsulfopropyl) disulfide, 3-(N,N-dimethylthiocarbamoyl)-thiopropanesulfonic acid or the respective sodium salt thereof and mixtures of the aforementioned; at least one amine reaction product of diethylamine with epichlorohydrin or an amine reaction product of isobutyl amine with epichlorohydrin or mixtures of these reaction products; at least one ethylene diamine compound selected from the group having attached EO-PO-block polymers, attached EO-PO-block polymers and sulfosuccinate groups and mixtures thereof; at least one aromatic reaction product of benzylchloride with at least one polyalkylenimine and a method for electrolytically depositing of a copper coating using the electroplating bath.

16 Claims, No Drawings

AQUEOUS ACIDIC COPPER ELECTROPLATING BATH AND METHOD FOR ELECTROLYTICALLY DEPOSITING OF A COPPER COATING

The present application is a U.S. National Stage Application based on and claiming benefit and priority under 35 U.S.C. § 371 of International Application No. PCT/EP2018/064337, filed 31 May 2018, which in turn claims benefit of and priority to European Application No. 17176308.9 filed 16 Jun. 2017, the entirety of both of which is hereby incorporated herein by reference.

FIELD OF THE INVENTION

The present invention relates to an aqueous acid copper electroplating bath for electrolytically depositing of a copper coating and a method for electrolytically depositing of a copper coating, especially of a bright and homogeneous copper coating.

BACKGROUND OF THE INVENTION

Various methods and deposition solutions for copper plating are used to produce decorative bright and levelled surfaces, large surfaces for instance, on metals or plastic materials. Among others, they are used to form ductile layers, for example in the field of decorative coatings for sanitary or automotive equipment where there is a need for intermediate copper layers for subsequent deposition of different metal layers e.g. for corrosion protection and/or decorative layers.

A homogeneous and bright appearance is especially required for final metal layers on the surface of the substrate. The homogeneity of the appearance can be easily achieved on substrates which have no complex shape because the current density distribution during electroplating of the copper layer is within a narrow range.

Various additives known as brighteners, levellers, surfactants can be added which are responsible for the quality of the deposits in view of e.g. distribution of brightness and plain deposition and also for the characteristics of the deposition bath in view of applicable current density and bath stability.

The utilization of certain dyes as *phenazinium* compounds and of the derivatives thereof for producing bright copper layers has long been known. These *phenazinium* compounds, which are described for example in DE 947 656 Cl, are used as additives in a bath for the electrolytic production of copper coatings.

US 2008210569 A1 describes an aqueous acidic solution for electrolytically depositing a copper deposit using polyvinylammonium compound to produce decorative bright and level surfaces.

The use of reaction products of polyalkanolamines with an alkylating agent or a quatemization agent (U.S. Pat. No. 4,110,176) and of polyalkylene imines with epichlorohydrin and an alkylating agent (EP 0 068 807 A2) as an additive in copper baths instead of dyestuffs for producing bright and levelled coatings is also described.

DE 196 43 091 A 1 describes an agent for treating metallic or metallized surfaces, said agent containing water soluble reaction products of water soluble polyamidoimines and/or polyimines with epichlorohydrin, as well as the use of this agent in copper baths, noble metal baths or alloy baths and a method of manufacturing these agents. Although the plating baths described allow achieving well distributing, ductile copper deposits, the coatings show hardly any levelling and are therefore not suitable for decorative purposes.

EP 1 197 587 A2 describes compositions comprising metal ions and branched heteroatoms containing suppressor compounds. The composition can be used for repair and electroplating of seed layers.

U.S. Pat. No. 4,336,114 describes a composition and method for electrodepositing ductile, bright, level copper deposits from an aqueous acidic copper plating electrolyte particularly suited for plating electronic circuit boards containing a brightening and leveling amount of a brightening and leveling system comprising (a) a bath soluble substituted phthalocyanine radical, (b) a bath soluble adduct of a tertiary alkyl amine with polyepichlorohydrin, (c) a bath soluble organic divalent sulfur compound, and (d) a bath soluble reaction product of polyethyleneimine and an alkylating agent which will alkylate the nitrogen on the polyethyleneimine to produce a quaternary nitrogen.

U.S. Pat. No. 2,842,488 describes process of producing bright copper electrodeposits from acid copper electroplating baths comprising hard water, technical grade copper salts and a-sulfonic acid brightening agent.

However, in cases where the substrate to be coated has a complex shape or there are structures such as small reliefs of letterings or symbols within the surface of the substrate to be plated, the electrolyte flow and the local current densities on the surface might vary during electroplating is within a wide range causing plating defects. Typical substrates having a complex shape or surface to be plated with metal deposits are for example automotive interior parts, front grills or emblems having reliefs of symbols or writings e.g. of the car manufacturer.

Additionally, some copper electrolytes described above do not allow the use of high current densities as is desired for electroplating. The additives described are only effective in a narrow range of current density.

For such substrates having complex shapes and/or structured surfaces known methods and plating solutions are not sufficient. It is not possible to produce decorative bright and conformal surfaces that have no undesirable effects such as over-levelled structures, hydrodynamic defects, pitting and nodules. Furthermore, when using known solutions, it is not possible to achieve good leveling performance without compromising the bright appearance of the surface layer and using higher current densities. Especially small structures with protrusions, different deep recesses or increments show undesired different copper growth resulting in uneven surface appearance wherein the coating will not smoothly follow the shape of the structures.

Furthermore, it is often not possible to achieve a reproducible quality of particularly bright, i.e. mirror-polished, as well as well levelled and ductile copper deposits.

OBJECTIVE OF THE PRESENT INVENTION

Thus, one object of the present invention is to circumvent the disadvantages of the known copper baths and methods during the metallization of workpieces, such as of metal or plastic substrates, and more specifically to provide additives allowing for reproducibly manufacturing particularly bright as well as levelled and ductile copper coatings.

Another object of the invention is to make it possible to avoid the shortcomings of the prior art and provides an electroplating bath and a method for depositing copper.

It is another object of the present invention that the applicable current density is as high as possible to improve plating performance wherein at the same time the effect of building of uneven coatings on complex shapes and/or structured surfaces using higher during densities is avoided.

SUMMARY OF THE INVENTION

This object is solved by an aqueous acidic copper electroplating bath comprising:

- copper ions;
- at least one acid;
- halide ions;
- at least one sulfur containing compound selected form the group consisting of sodium 3-mercaptopropylsulfonate, bis(sodiumsulfopropyl)disulfide, 3-(N,N-dimethylthiocarbamoyl)-thiopropanesulfonic acid or the respective sodium salt thereof and mixtures of the aforementioned;
- at least one amine reaction product of diethylamine with epichlorohydrin or an amine reaction product of isobutyl amine with epichlorohydrin or mixtures of these reaction products wherein the at least one amine reaction product of diethylamine with epichlorohydrin or isobutyl amine with epichlorohydrin comprises a mixture of at least tertiary and/or quaternary ammonium compounds;
- at least one ethylene diamine compound selected from the group having attached EO-PO-block polymers, attached EO-PO-block polymers and sulfosuccinate groups and mixtures thereof;
- at least one aromatic reaction product of benzylchloride with at least one polyalkylenimine wherein the at least one aromatic reaction product comprises a benzylated polyalkylenimine or benzylated polyalkylenimines forming a mixture.

This object is further solved by a method for electrolytically depositing of a copper coating, especially a bright and homogeneous copper coating, onto a substrate from the electroplating bath above comprising the steps in the following order:

- providing the substrate having a surface to be electroplated,
- bringing the substrate in contact with the bath, and
- applying a current between the substrate and an anode and thereby depositing a copper coating onto the surface of the substrate.

The electroplating bath of the present invention can be used advantageously for the electrolytic manufacturing of a bright, levelled copper coating onto substrates for use in producing decorative and/or ductile surfaces of these substrates. The good levelling performance can be seen for example in that the copper coating does significantly reduce the visibility of defects from the substrate e.g. from a plastic surface. The bath can be especially utilized for the decorative copper plating of plastic parts for the sanitary and automotive industry which have in particular a complex shape.

With the electroplating bath and the method of the present invention copper coatings are obtained which have further a bright and homogeneous appearance and at the same time the coatings are very conformal to the relief and structures within the surface of the substrate having a complex shape. Over-levelling (orange peel) and hydrodynamic defects (surface defects caused by a locally and severely increased Cu-thickness causing soft, rounded reliefs instead of conformal reliefs e.g. of letterings) at protrusions within the surface of the substrate are strongly reduced. Reliefs are structural elements having recessed and/or raised parts within the substrate surface.

Furthermore, fewer tendencies to burning and build-up of copper at edges of the substrate or at reliefs within the surface and less susceptibility to pits and pores are observed. If higher levelling performance beside the still improved brightness of the coatings is needed, the concentration of the following additives—amine reaction product, ethylene diamine compound and aromatic reaction product—can be adjusted at higher concentrations to provide more levelled coatings wherein at the same time the hydrodynamic defects are provided.

The term "complex shape" in respect to substrates to be plated by the method according to the present invention is in particular defined herein as a shape which generates local turbulences generating strongly varying local mass transport to the surface during electroplating because of small reliefs and structures within the surface of the substrate. In contrast, a substrate having e.g. an essentially flat, plate-like shape such as a metal strip is not considered as substrate having a complex shape.

The combination of the different additives is useful at different concentrations for depositing at reasonable plating times copper coatings onto the reliefs and structures of the substrate to be plated but at the same time e.g. does not over-levelling these reliefs and structures.

DETAILED DESCRIPTION OF THE INVENTION

Preferred embodiments of the invention are explained in the following and also more detailed in the examples.

The aqueous acidic copper electroplating bath according to the present invention is substantially free of dyes or dye-containing additives, respectively. That means, no dyes or dye-containing additives, such as phenazine dyes, in particular no strong-staining dyes under visible light (VIS) conditions are added to the electroplating bath because the dye-containing additives have the disadvantage of undesired strong levelling effects and also have very strong colours which stain the electrolyte, the equipment and the surrounding of the plating tank.

The basic aqueous acidic copper electroplating bath may vary within wide limits. Generally, an aqueous acidic copper electroplating bath is used, having: copper (II) ions, preferably in a concentration from 20 to 300 g/l, more preferably from 120 to 270 g/l; at least one acid, preferably in a concentration from 50 to 350 g/l, more preferably from 50 to 150 g/l; halide ions preferably in a concentration from 10 to 250 mg/l, more preferably from 40 to 160 mg/l; a sulfur containing compound selected from the group consisting of sodium 3-mercaptopropylsulfonate, bis(sodiumsulfopropyl) disulfide (SPS), 3-(N,N-dimethylthiocarbamoyl)-thiopropanesulfonic acid the respective sodium salt thereof and mixtures of the aforementioned are added to the electroplating baths of the invention, preferably in a concentration from 2 to 70 mg/l, more preferably from 5 to 50 mg/l.

As a source of copper ions preferably copper (II) sulfate ($CuSO_4 \times 5H_2O$) is used. At least in parts, other copper salts than copper sulfate can be used.

The at least one acid is preferably selected from the group consisting of a mineral acid, an alkylsulfonic acid, and mixtures thereof. In a preferred embodiment the at least one acid is sulfuric acid and/or hydrochloric acid as mineral acid, which also can be replaced in part by methanesulfonic acid and/or propanesulfonic acid. The pH value of the bath is preferably 1 or below 1.

As halide ions preferably chloride ions are used and added preferably as alkali chloride (e.g. sodium chloride) or in the form of hydrochloric acid. The addition of halide ions can be omitted in part or in whole if the compounds or reaction products of the inventive electroplating bath already contain halide ions.

To complete and provide the electroplating bath according to the invention, the further compounds and reaction products are added to the basic electroplating bath.

The concentration of the amine reaction product of diethylamine with epichlorohydrin in the electroplating bath and the concentration of the amine reaction product of isobutyl amine with epichlorohydrin in the electroplating bath is from 5 to 200 mg/l. If mixtures of amine reaction products are used, the total concentration of the mixture in the bath is from 5 to 200 mg/l.

According to the invention the amine reaction product of diethylamine with epichlorohydrin or isobutyl amine with epichlorohydrin comprises a mixture of at least tertiary and/or quaternary ammonium compounds, more preferred both reaction products comprise quaternary ammonium compounds. In an even more preferred embodiment an amine reaction product of diethylamine with epichlorohydrin is a product obtainable under CAS-No. 88907-36-2, CAS-No. 80848-16-4 or CAS-No. 80848-02-8.

The at least one polyalkylenimine used for the reaction with benzylchloride has preferably 2 or more nitrogen atoms, preferably 2 to 60 nitrogen atoms, more preferred 2 to 50 nitrogen atoms, even more preferred 5 to 40 nitrogen atoms or 10 to 25 nitrogen atoms.

The polyalkylenimine have preferably the general formula (I),

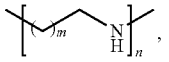

(I)

wherein m and n are integers and m is 1-2 and n>2, preferably 2-60, more preferred 2 to 50, even more preferred 5 to 40 or 10 to 25.

The used polyalkylenimines can be branched polyalkylenimines or linear polyalkylenimines or mixtures thereof. The linear polyalkylenimines contain predominantly secondary amino groups. The branched polyalkylenimines contain primary, secondary and tertiary amino groups. Preferably, the polyalkylenimine is a polyethylenimine or a polypropylenimine.

The at least one aromatic reaction product of benzylchloride with polyalkylenimine means in this context a reaction products of benzylchloride with one or more polyalkylenimines resulting in a benzylated polyalkylenimine or benzylated polyalkylenimines forming a mixture. The benzylated polyalkylenimine or the benzylated polyalkylenimine of mixture has each 2 or more nitrogen atoms, preferred 2 to 60 nitrogen atoms, more preferred 2 to 50 nitrogen atoms, even more preferred 5 to 40 nitrogen atoms or 10 to 25 nitrogen atoms.

In one embodiment of the invention, the reaction of a mixture of polyalkylenimine having each 5 to 40 nitrogen atoms with benzylchloride results in an aromatic reaction product comprising benzylated polyalkylenimines having nitrogen atoms, e.g. 5 to 40 nitrogen atoms forming a mixture.

Preferably the benzylated polyalkylenimines or mixture of benzylated polyalkylenimines contains benzylated polyalkylenimines having benzylated amino groups which are primary, secondary, or tertiary amino groups which are benzylated with 0 to 3 benzyl groups and wherein the benzylated amino groups can be interlinked to each other by alkylene (also referred to as alkanediyl groups in the art) groups with the proviso that at least one amino group is benzylated.

In a more preferred embodiment the at least one aromatic reaction product is an aromatic reaction product of benzylchloride with polyethylenimine. Preferably, the polyethylenimine has 2 to 60 nitrogen atoms, more preferred 2 to 50 nitrogen atoms, even more preferred 50 to 40 nitrogen atoms or 10 to 25 nitrogen atoms. More preferably the polyethylenimine has 2 to 60 nitrogen atoms, more preferred 2 to 50 nitrogen atoms, even more preferred 5 to 40 nitrogen atoms or 10 to 25 nitrogen atoms.

In a more preferred embodiment a benzylated polyalkylenimine is a product obtainable under CAS-No. 68603-67-8.

The concentration of the at least one aromatic reaction product in the electroplating bath is from 0.1 to 6 mg/l, preferably from 1 to 5 mg/l. If mixtures of aromatic reaction products are used, the total concentration of the mixture in the electroplating bath is from 1 to 5 mg/l.

In the preferred embodiment of the invention the concentration in the electroplating bath of the at least one the ethylene diamine compounds which have attached EO-PO-block polymers only, or attached EO-PO-block polymers and sulfosuccinate groups or mixtures thereof is from 50 to 400 mg/l. EO-PO-block polymers in this context means polymers without having cap-groups as sulfosuccinate groups. If mixtures of ethylene diamine compounds are used, the total concentration of the mixture in the electroplating bath is from 50 to 400 mg/l, preferably from 20 to 250 mg/l.

Preferably, the attached EO-PO-block polymer of the ethylene diamine compounds has a molecular weight between 500 and 7000 g/mol and preferably the block polymer has an EO/PO ratio of 0.88.

In a more preferred embodiment an ethylene diamine compound having attached EO-PO-block polymers only is a product obtainable under CAS No. 26316-40-5. In another preferred embodiment of an ethylene diamine compound which have attached EO-PO-block polymers and sulfosuccinate groups is a product obtainable under CAS No. 26316-40-5sulf (sulf means sulfosuccinated).

If higher levelling performance beside the still improved brightness of the coatings is needed, the concentration of the additives—amine reaction product, ethylene diamine compound and aromatic reaction product—can be adjusted at higher concentrations to provide more levelled coatings, wherein the concentration of the at least one amine reaction product of diethylamine with epichlorohydrin is from 50 to 200 mg/l preferably from 50 to 150 mg/l; the concentration of the at least one ethylene diamine compound is from 50 to 400 mg/l and the concentration of at least one aromatic reaction product is from 0.1 to 6 mg/l.

In a preferred embodiment of the invention the electroplating bath additionally comprises at least one inhibitor compound selected from the group consisting of one or more polyethylene glycols having a molecular weight from 1000 to 20000 g/mol, preferably between 3000 and 10000 g/mol; polypropylene glycol having a molecular weight from 400 to 2000 g/mol; and EO-PO co-polymer (block or random) having a molecular weight from 1000 to 10000 g/mol, preferably from 1000 to 1500 g/mol. The concentration of the inhibitor compound in the bath is from 0.5 to 200 mg/l.

If mixtures of inhibitor compounds are used, the total concentration of the mixture in the electroplating bath is from 7 to 200 mg/l.

Preferred inhibitors which can be used alone or in combination are PEG-DME 2000, PEG 6000, PEG 10000 and PPG 900.

The inhibitor compound helps to prevent or further reduces the formation of pores within the copper coatings.

In a preferred embodiment of the invention the electroplating bath additionally comprises further Fe (II) ions in a concentration of 50 to 1000 mg/l. The addition of Fe (II) ions has positive influences of the consumptions of organic additives. The Fe (II) ions preferably derived from water soluble iron salts, e.g. $FeSO_4 \times 7H_2O$.

The invention further provides a method for electrolytically depositing of a copper coating onto a substrate from an electroplating bath according to the invention above comprising the steps in the following order:

providing the substrate having a surface to be electroplated, bringing the substrate into contact with the electroplating bath, and applying a current between the substrate and an anode, and thereby depositing a copper coating onto the surface of the substrate.

The operating conditions of the bath during deposition can preferably be adjusted as follows:

pH value: <1,

Temperature: 15° C. to 45° C., preferably from 20° C. to 35° C.,

Cathodic current density: 0.5 to 12 $A/dm^2$, preferably from 2 to 6 $A/dm^2$

The electrolyte motion can be caused by electrolyte circulation, cathode movement and/or blowing in air.

The following examples are used to explain the invention and are not-limiting:

General Procedure:

The plating experiments were conducted in a Hull-cell in order to simulate a wide range of local current densities on the substrate ("Hull-cell panel") during electroplating. The substrate material was brass and the size was 100 mm×75 mm.

The desired technical effect of an improved brightness performance of the plating bath was determined by visual inspection of the deposited copper coatings in view of brightness over the whole Hull-cell panel. The inspection of the Hull cell panels was made from high local current density (HCD) point to the low local current density (LCD) point of the Hull cell panels. The HCD point was specified as a starting point from the left border of the Hull cell. Starting at this point, the current density over the Hull cell panel decreases locally step by step to the LCD point at the right border of the Hull cell panel. The distance from the left to the right border of the Hull cell panels refers to a value of 100%, if no changes over the length of 100 mm in brightness in direction to the LCD point is observed. If e.g. 90% of the distance in direction of the LCD point is not visual changed, the remaining 10% of the distance in direction to LCD point of the Hull cell panel is visual decrease in quality of brightness in contrast to the remaining 90%.

The brightness performance of the plating bath tested was determined by the visual inspection of the Hull cell panel between HCD and LCD point, and the effect of the different additives alone or in combination was determined by comparing the panels prepared, using a basic aqueous acidic copper electroplating bath with different additives alone or in combination as explained in the examples.

The applied electrical current at the left border of the Hull cell panel was 2 A. Plating time was 10 min. Temperature of the bath was 25° C.

Basic aqueous acidic copper electroplating:

| | |
|---|---|
| $CuSO_4 \times 5H_2O$ | 220.0 g/l |
| Sulfuric acid (96% per weight) | 70.0 g/l |
| NaCl | 80.0 mg/l |

The indication of concentration of the additives within the examples refers to final concentrations of the plating bath.

Example 1-3 (Comparative Examples)

Example 1

The brightness performance of a basic aqueous acidic coper electroplating bath comprising 1a) 20 mg/l 3-mercaptopropylsulfonate (SPS) and 200 mg/l PEG 6000, 1b) composition 1a)+30 mg/l amine reaction product of diethylamine with epichlorohydrin (CAS-No. 88907-36-2), 1c) composition 1b)+40 mg/l ethylene diamine compound which have attached EO-PO-block polymers (EO-PO EDA; CAS No. 26316-40-5) were tested. The Hull cell panel showed over a distance of:

1a) 60% a semi-bright to weak-bright coating and 40% satin appearance;

1b) 70% a weakly bright and 30% satin coating;

1c) 80% a weakly bright and 20% satin coating.

Example 2

The brightness performance of a basic aqueous acidic coper electroplating bath comprising 2a) 5 mg/l SPS, 50 mg/l PEG 6000 and 80 mg/l ethylene diamine compound which have attached EO-PO-block polymers (EO-PO EDA; CAS No. 26316-40-5), 2b) composition 2a)+25 mg/l amine reaction product of diethylamine with epichlorohydrin (CAS-No. 88907-36-2), 2c) composition 2b)+25 mg/l amine reaction product of diethylamine with epichlorohydrin (CAS-No. 88907-36-2), 2d) composition 2c)+50 mg/l amine reaction product of diethylamine with epichlorohydrin (CAS-No. 88907-36-2) were tested.

The Hull cell panel showed over a distance of:

2a) 70% a semi-bright to weak-bright coating and 30% satin appearance;

2b) 70% a semi-bright to weak-bright coating and 30% satin appearance;

2c) 70% a semi-bright to weak-bright coating and 30% satin appearance;

2d) 70% a semi-bright to weak-bright coating and 30% satin appearance.

Example 3

The brightness performance of a basic aqueous acidic coper electroplating bath comprising 3a) 20 mg/l SPS and 200 mg/l EO-PO (random, average molar mass $M_w$: 1100-1300 g/mol) 3b) composition 3a)+0.8 mg/l benzylated polyalkylenimine (CAS-No. 68603-67-8); 3c) composition 3a)+1.6 mg/l benzylated polyalkylenimine (CAS-No. 68603-67-8); and 3d) composition 3a)+3.2 mg/l benzylated polyalkylenimine (CAS-No. 68603-67-8) were tested.

The Hull cell panel showed over a distance of:

a) 75% a semi-bright to weak-bright coating;

b) 85% a semi-bright to weak-bright coating;

c) 50% a bright and 50% satin bright coating;
d) 65% a bright and 35% satin bright coating.

Example 4 (Inventive Example)

The brightness performance of a basic aqueous acidic coper electroplating bath comprising 4a) 5 mg/l SPS, 50 mg/l PEG 6000, 40 mg/l ethylene diamine compound having attached EO-PO-block polymers (EO-PO EDA; CAS No. 26316-40-5), 30 mg/l amine reaction product of diethylamine with epichlorohydrin (CAS-No. 88907-36-2), and 0.4 mg/l benzylated polyalkylenimine (CAS-No. 68603-67-8) was tested.

The Hull cell panel showed over a distance of
4a) 85% a bright coating and 15% satin bright coating.

Examples 5-7 (Inventive Examples)

For the following inventive examples comparable substrates were used as above but the substrates were provided with identically arranged scratches over the whole surface of the substrate. According to the basic aqueous acidic copper electroplating bath, it was slightly altered in concentration of SPS from 7 to 31 mg/l according to the examples:

| | |
|---|---|
| $CuSO_4 \times 5H_2O$ | 220.0 g/l |
| Sulfuric acid (96% per weight) | 70.0 g/l |
| NaCl | 130.0 mg/l |

The desired technical effect of an improved brightness and levelling performance of the plating bath was determined again by visual inspection of the deposited copper coatings in view of brightness and levelling over the whole Hull-cell panel.

The examples showed that higher concentrations of the additives (i.e. the amine reaction product, the ethylene diamine compound and the aromatic reaction product) of the inventive electroplating bath results beside good brightness and levelling performance also in an additionally improved levelling performance.

Example 5 (Inventive Example)

The brightness and levelling performance of a basic aqueous acidic coper electroplating bath comprising 5a) 38.0 mg/l amine reaction product of diethylamine with epichlorohydrin (CAS-No. 68391-06-0), 50.0 mg/l ethylene diamine compound which have attached EO-PO-block polymers (EO-PO EDA; CAS No. 26316-40-5), 2.0 mg/l benzylated polyalkylenimine (CAS-No. 68603-67-8), 15 mg/l PEG 6000 and 25.0 mg/l SPS; and 5b) 94.0 mg/l amine reaction product of diethylamine with epichlorohydrin (CAS-No. 88907-36-2), 125.0 mg/l ethylene diamine compound which have attached EO-PO-block polymers (EO-PO EDA; CAS No. 26316-40-5), 5.0 mg/l benzylated polyalkylenimine (CAS-No. 68603-67-8), 40 mg/l PEG 6000 and 13.0 mg/l SPS, was tested.

The Hull cell panel showed over a distance of
5a) 80% a bright and 20% satin bright coating plus additionally weak levelling effect;
5b) 80% a bright and 20% satin bright coating plus very strong levelling effect.

Example 6 (Inventive Example)

The brightness and levelling performance of a basic aqueous acidic coper electroplating bath comprising 6a) 50.0 mg/l amine reaction product of diethylamine with epichlorohydrin (CAS-No. 88907-36-2, 130.0 mg/l ethylene diamine compound which have attached EO-PO-block polymers and sulfosuccinate groups (EO-PO EDAsulf; CAS No. 26316-40-5sulf), 1.0 mg/l benzylated polyalkylenimine (CAS-No. 68603-67-8), 25 mg/l PEG 6000 and 7.0 mg/l SPS; and 6b) 150.0 mg/l amine reaction product of diethylamine with epichlorohydrin (CAS-No. 88907-36-2), 390.0 mg/l ethylene diamine compound which have attached EO-PO-block polymers and sulfosuccinate groups (EO-PO EDAsulf; CAS No. 26316-40-5sulf), 3.0 mg/l benzylated polyalkylenimine (CAS-No. 68603-67-8), 80 mg/l PEG 6000 and 13.0 mg/l SPS, was tested.

The Hull cell panel showed over a distance of
6a) 75% a bright and 25% satin bright coating plus additionally weak levelling effect;
6b) 85% a bright and 15% satin bright coating plus very strong levelling effect.

Example 7

The brightness and levelling performance of a basic aqueous acidic coper electroplating bath comprising 7a) 5.0 mg/l amine reaction product of diethylamine with epichlorohydrin (CAS-No. 88907-36-2), 20.0 mg/l ethylene diamine compound which have attached EO-PO-block polymers and sulfosuccinate groups (EO-PO EDAsulf; CAS No. 26316-40-5sulf), 4.0 mg/l ethylene diamine compound which have attached EO-PO-block polymers (EO-PO EDA; CAS No. 26316-40-5), 0.2 mg/l benzylated polyalkylenimine (CAS-No. 68603-67-8), 5 mg/l PEG 6000 and 8.0 mg/l SPS; and 7b) 50.0 mg/l amine reaction product of diethylamine with epichlorohydrin (CAS-No. 88907-36-2), 200.0 mg/l ethylene diamine compound which have attached EO-PO-block polymers and sulfosuccinate groups (EO-PO EDAsulf; CAS No. 26316-40-5sulf), 40.0 mg/l ethylene diamine compound which have attached EO-PO-block polymers (EO-PO EDA; CAS No. 26316-40-5), 2.0 mg/l benzylated polyalkylenimine (CAS-No. 68603-67-8), 50 mg/l PEG 6000 and 31.0 mg/l SPS, was tested.

The Hull cell panel showed over a distance of
a) 75% a bright and 25% satin bright coating plus additionally weak levelling effect;
b) 85% a bright and 15% satin bright coating plus very strong levelling effect.

The invention claimed is:

1. Aqueous acidic copper electroplating bath comprising:
20 to 270 g/l of copper ions;
50 to 150 g/l of at least one acid;
40 to 160 mg/l of halide ions;
at least one sulfur containing compound selected from the group consisting of sodium 3-mercaptopropylsulfonate, bis(sodiumsulfopropyl)disulfide, 3-(N,N-dimethylthiocarbamoyl)-thiopropanesulfonic acid and the respective sodium salt thereof;
5 to 200 mg/l of at least one of an amine reaction product of diethylamine with epichlorohydrin or an amine reaction product of isobutyl amine with epichlorohydrin or mixtures thereof wherein the at least one amine reaction product of diethylamine with epichlorohydrin or isobutyl amine with epichlorohydrin comprises a mixture of at least tertiary and/or quaternary ammonium compounds;
at least one ethylene diamine compound selected from ethylene diamine compounds having attached EO-PO-block polymers, ethylene diamine compounds having attached EO-PO-block polymers and sulfosuccinate groups and mixtures thereof;

at least one aromatic reaction product of benzylchloride with at least one polyalkylenimine, wherein the at least one aromatic reaction product comprises a benzylated polyalkylenimine or a mixture of benzylated polyalkylenimines; and one or more polyethylene glycol having a molecular weight from 1000 to 20000 g/mol.

2. The electroplating bath according to claim 1 wherein the benzylated polyalkylenimine or the mixture of benzylated polyalkylenimines has each 2 or more nitrogen atoms.

3. The electroplating bath according to claim 1 wherein, in the mixture of benzylated polyalkylenimines, the benzylated polyalkyleneimines contain benzylated polyalkylenimines having benzylated amino groups which are primary, secondary, or tertiary amino groups which are benzylated with 0 to 3 benzyl groups and wherein the benzylated amino groups can be interlinked to each other by alkylene groups with the proviso that at least one amino group is benzylated.

4. The electroplating bath according to claim 1 wherein the at least one aromatic reaction product is the aromatic reaction product of the benzylchloride with polyethylenimine.

5. The electroplating bath according to claim 1 wherein the attached EO-PO-block polymers have a molecular weight between 500 and 7000 g/mol and the attached EO-PO-block polymers have an EO/PO ratio of 0.88.

6. The electroplating bath according to claim 1 wherein the bath further comprises at least one inhibitor compound selected from the group consisting of one or more polypropylene glycol having a molecular weight from 400 to 2000 g/mol and EO-PO co-polymer having a molecular weight from 1000 to 10000 g/mol.

7. The electroplating bath according to claim 1 wherein the at least one amine reaction product of diethylamine with epichlorohydrin or isobutyl amine with epichlorohydrin comprises a quaternary ammonium compound.

8. The electroplating bath according to claim 1 wherein the at least one acid is selected from the group consisting of mineral acids, an alkylsulfonic acid, and mixtures thereof.

9. The electroplating bath according to claim 1 wherein the pH value of the bath is below 1.

10. The electroplating bath according to claim 1 wherein the bath further comprises a source of Fe (II) ions in a concentration of 50 to 1000 mg/l.

11. The electroplating bath according to claim 1 wherein the bath contains a mixture of amine reaction products, and total concentration of the mixture of amine reaction products in the bath is from 5 to 200 mg/l.

12. The electroplating bath according to claim 1 wherein the concentration of the at least one ethylene diamine compound in the bath is from 50 to 400 mg/l.

13. The electroplating bath according to claim 1 wherein the concentration of the at least one aromatic reaction product in the bath is from 0.1 to 6 mg/l.

14. Method for electrolytically depositing of a copper coating onto a substrate from the electroplating bath according to claim 1 comprising the steps in the following order:

providing the substrate having a surface to be electroplated, bringing the substrate into contact with the bath having a temperature from 15° C. to 45° C., and applying a current between the substrate and an anode, and thereby depositing the copper coating onto the surface of the substrate.

15. Aqueous acidic copper electroplating bath comprising:

20 to 270 g/l copper ions;

50 to 150 g/l of at least one acid;

40 to 160 mg/l of halide ions;

5 to 50 mg/l bis(sodiumsulfopropyl)disulfide;

5 to 200 mg/L of at least one of an amine reaction product of diethylamine with epichlorohydrin or an amine reaction product of isobutyl amine with epichlorohydrin or mixtures thereof wherein the at least one amine reaction product of diethylamine with epichlorohydrin or isobutyl amine with epichlorohydrin comprises a mixture of at least tertiary and/or quaternary ammonium compounds;

20 to 250 mg/l of at least one ethylene diamine compound selected from ethylene diamine compounds having attached EO-PO-block polymers, ethylene diamine compounds having attached EO-PO-block polymers and sulfosuccinate groups and mixtures thereof;

0.1 to 6 mg/l of at least one aromatic reaction product of benzylchloride with at least one polyalkylenimine, wherein the at least one aromatic reaction product comprises a benzylated polyalkylenimine or a mixture of benzylated polyalkylenimines;

one or more polyethylene glycol having a molecular weight from 1000 to 20000 g/mol; and one or more polypropylene glycol having a molecular weight from 400 to 2000 g/mol.

16. Method for electrolytically depositing of a copper coating onto a substrate from the electroplating bath according to claim 15 comprising the steps in the following order:

providing the substrate having a surface to be electroplated, bringing the substrate into contact with the bath having a temperature from 15° C. to 45° C., and applying a current between the substrate and an anode, and thereby depositing the copper coating onto the surface of the substrate.

* * * * *